US012516918B1

(12) United States Patent
Speirs et al.

(10) Patent No.: US 12,516,918 B1
(45) Date of Patent: Jan. 6, 2026

(54) NOSEPIECE FOR SUPPRESSING A WATER-ENTRY CAVITY

(71) Applicant: The United States of America as represented by the Secretary of the Navy, Newport, RI (US)

(72) Inventors: Nathan B Speirs, Provo, UT (US); Aren M Hellum, Wakefield, RI (US); Jesse L Belden, Dighton, MA (US)

(73) Assignee: The United States of America as represented by the Secretary of the Navy

( * ) Notice: Subject to any disclaimer, the term of this patent is extended or adjusted under 35 U.S.C. 154(b) by 385 days.

(21) Appl. No.: 18/370,007

(22) Filed: Sep. 19, 2023

(51) Int. Cl.
*F42B 19/00* (2006.01)

(52) U.S. Cl.
CPC ..... *F42B 19/005* (2013.01)

(58) Field of Classification Search
CPC ..... F42B 10/52; F42B 17/00; F42B 19/005; F42B 19/125; B63B 1/36
See application file for complete search history.

(56) References Cited

U.S. PATENT DOCUMENTS 2,889,772 A * 6/1959 Howard ..... F42B 19/005 102/390
2,936,710 A * 5/1960 Bollay ..... F42B 10/52 244/113
3,041,992 A * 7/1962 Lee ..... B63G 8/00 114/67 R
3,205,822 A * 9/1965 Lars ..... F42B 10/46 102/200
3,205,846 A * 9/1965 Lang ..... F42B 19/125 244/206
4,230,059 A * 10/1980 Kalaf ..... F42B 19/005 114/20.1
6,388,184 B1 * 5/2002 Glenning ..... F42B 19/005 89/1.809
6,739,266 B1 * 5/2004 Castano ..... F42B 10/38 114/20.1
11,885,600 B2 * 1/2024 Kiara ..... F42B 10/44
12,173,997 B1 * 12/2024 Speirs ..... F42B 19/125
12,281,875 B2 * 4/2025 Rushforth ..... F42B 10/38
2022/0057181 A1 * 2/2022 Kiara ..... F42B 19/125
2023/0417522 A1 * 12/2023 Kiara ..... F42B 19/125

(Continued)

FOREIGN PATENT DOCUMENTS

CN 109341443 A * 2/2019 ..... F42B 19/125
CN 109387122 A * 2/2019 ..... F42B 19/125
DE 10001503 C1 * 5/2001 ..... F42B 10/52

(Continued)

*Primary Examiner* — Joseph W Sanderson
(74) *Attorney, Agent, or Firm* — James M. Kasischke; Jeffry C. Severson

(57) ABSTRACT

A nosepiece is provided with a recess or cup shape with internal dimensions that provides cavity suppression of a body entering an air and water interface. The nosepiece includes a circular portion with a diameter connectable to a nose of the body. The circular portion has a cylindrical first section and a cylindrical second section with the recess as the formed cup in the first section at a depth where the diameter and depth are selected based on a Weber number for the body such that a cavity is suppressed as the nosepiece and the body enter the air and water interface.

5 Claims, 4 Drawing Sheets

(56) References Cited

U.S. PATENT DOCUMENTS

| | | | | |
|---|---|---|---|---|
| 2024/0003659 | A1* | 1/2024 | Rushforth | F41F 3/10 |
| 2024/0246637 | A1* | 7/2024 | Li | B63B 1/36 |

FOREIGN PATENT DOCUMENTS

| | | | | |
|---|---|---|---|---|
| DE | 20000534 | U1 * | 5/2001 | F42B 10/52 |
| JP | H0717999 | Y2 * | 4/1995 | F42B 10/48 |
| KR | 101570321 | B1 * | 11/2015 | B63B 1/34 |

* cited by examiner

- PRIOR ART -

NOSEPIECE FOR SUPPRESSING A WATER-ENTRY CAVITY

STATEMENT OF GOVERNMENT INTEREST

The invention described herein was made in the performance of official duties by employees of the U.S. Department of the Navy and may be manufactured, used, or licensed by or for the Government of the United States for any governmental purpose without payment of any royalties thereon.

CROSS REFERENCE TO OTHER PATENT APPLICATIONS

None.

BACKGROUND OF THE INVENTION

1) Field of the Invention

The present invention is directed to a nosepiece capable of suppressing cavity formation upon vertical entry of a body into water.

2) Description of the Prior Art

A growing number of operational applications require bodies to travel in air and underwater. Such applications sometimes require the body to pass through an air-water interface in an event known as water entry. Often, the production of a cavity upon water entry is desirable, as in the case of a supercavitating body. However, in certain applications, it is beneficial to suppress the cavity such that the body is fully wetted upon water entry. For example, if the body design requires that the rear control surfaces be wet for stability, then suppressing cavity formation is beneficial or even required.

FIG. 1 illustrates a typical entry of a body 100 into a water medium in which the entry produces an air cavity 200 that can envelope the body. Cavities are generally classified into regimes based on the body geometry and the impact Weber number, $We=\rho U^2D/\sigma$, with "ρ" as the water density, "U" being the impact speed, "D" as the characteristic length of the body. "D" is a characteristic length, which can change with the application, but is usually the body diameter. "σ" is the surface tension.

The Weber number is a dimensionless number in fluid mechanics that analyzes fluid flows where there is an interface between different fluids. The Weber number is associated with a measure of the relative importance of fluid inertia compared to surface tension. As shown in the figure, the body 100 has control surfaces 102 at a rear portion in which the control surfaces must be fully wetted to provide stability in the water. As such, the body 100 would be typically unstable upon water entry.

Nose shapes with sharp changes in curvature, such as disks and vertical cylinders, can readily form splashes and cavities. During cavity formation, the cavity continues to grow underwater and draws in air from above the surface until a sealing event closes the cavity. The cavity type typically falls into one of four regimes in which each regime is distinguished by the spatial location of the seal event.

In a deep seal, a cavity closes below the surface with the above surface splash crown still open to air. A surface seal closes off to the air above when the splash crown domes over on itself above the water surface. The seal location is usually spaced far apart from the body for deep and surface seals. However, it is also possible that the axial extent of the body is such that the seal point contacts the body. In this situation, the deep and surface closure phenomena still occur, except the sealing event is identified by a contact of the cavity or a splash with the body.

To avoid or minimize the cavity formation previously described, there is a need for a device that suppresses cavity formation for water entry of long slender bodies. This type of long slender body may have a length-to-diameter of approximately $1/d \geq 10$.

SUMMARY OF THE INVENTION

The present invention is a novel nose device or nosepiece that includes a recess or cup shape with internal dimensions in which the recess is capable of cavity suppression. For a cupped nose, the splash rim can contract quickly and seal on the body; thereby, preventing airflow into the cavity. By preventing airflow, cavity formation is suppressed.

The nosepiece includes a circular portion connected to or frangible with the nose of the body. The circular portion of the nosepiece has a first section and a second section. The circular dimension is a diameter "D" and a recess includes a depth "h". The recess can form cup shape in the nosepiece with the recess positioned to face the water entry. The dimensions for diameter D and depth h are based on the impact Weber number for the body.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
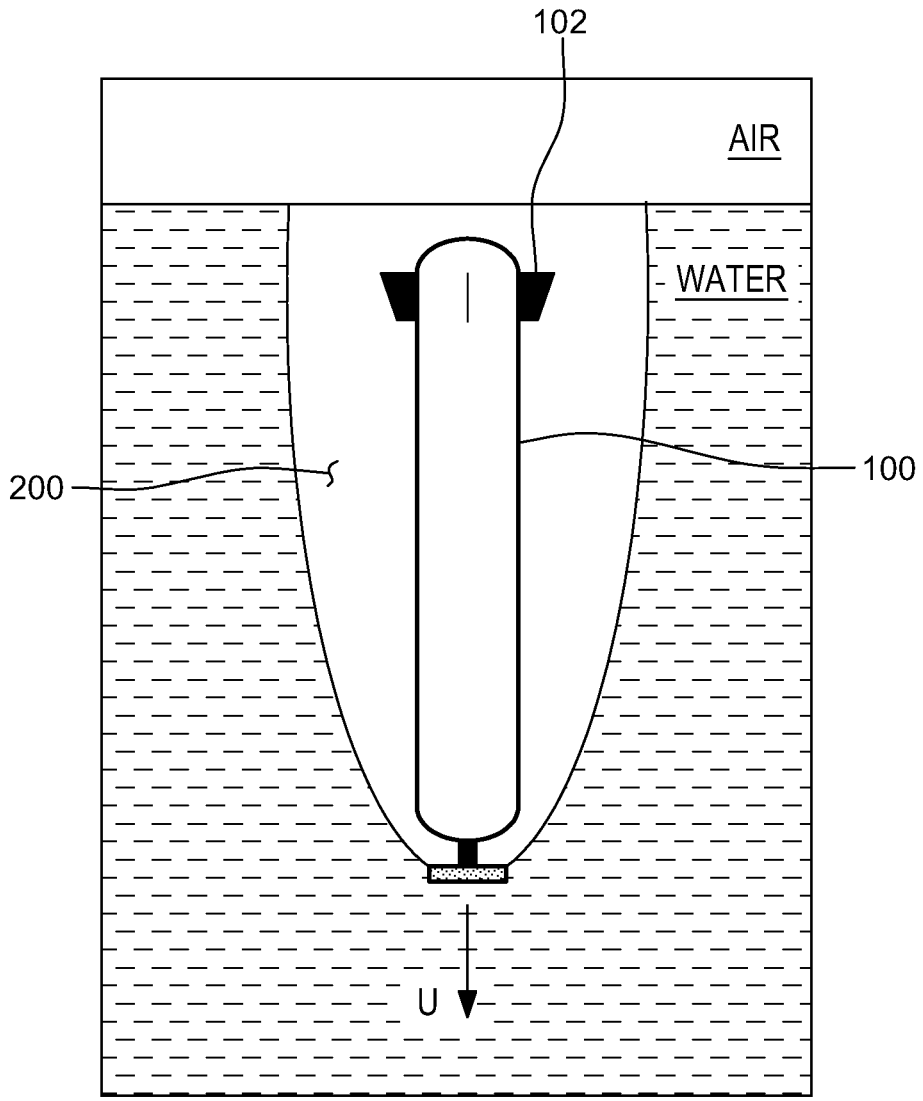
FIG. 1 is a prior art side view of a typical water entry of a body showing cavity formation in the water.
Figure 2:
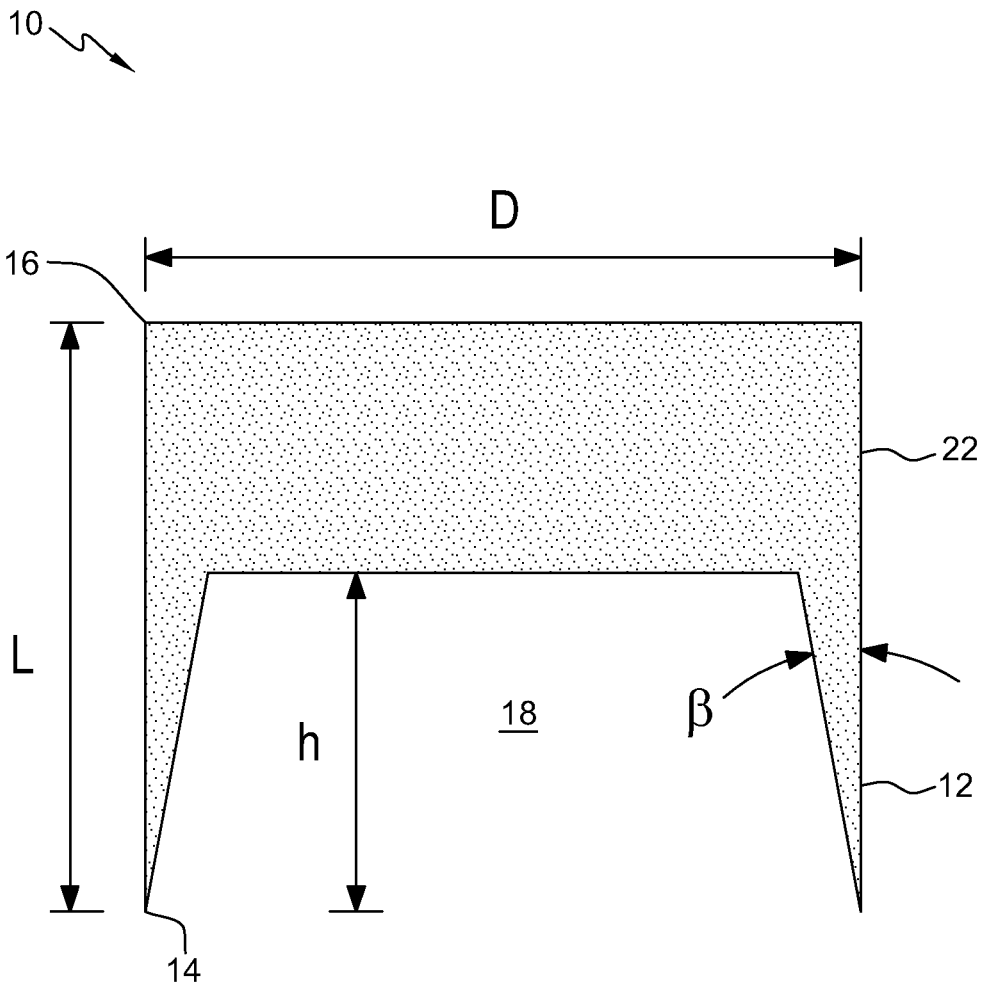
FIG. 2 is a side view of the nosepiece of the present invention.

Referring to FIG. 2, a nosepiece 10 of the present invention suppresses an air cavity around the body 100 upon vertical water entry. The nosepiece 10 consists of a body 12 having a circular cross section with a first end section 14, a second end section 16 and a diameter "D". The body 12 has a recess 18 with a depth "h". The walls 22 of the body 12 have a wedge cross-section expanding from the second end section 16 at an angle β. In some embodiments, the angle β could be small (i.e., $\beta \approx 10°$). The length L of the walls 22 need only be greater than the depth h of the recess 18.

Figure 3:
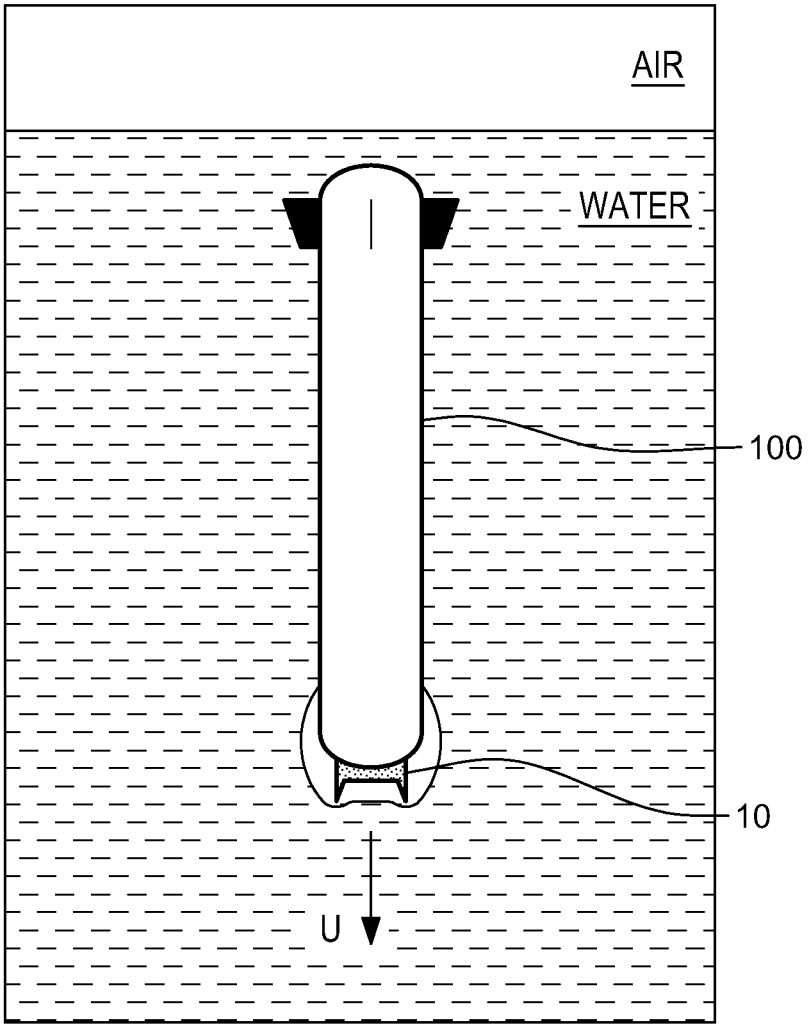
FIG. 3 is a side view of water entry of a body with the nosepiece achieving cavity suppression.

It is the specific ratio "h/D" for a given operating Weber number (We) that allows for the cavity suppression. FIG. 3 shows, by illustration, the water entry of the body 100 with the nosepiece 10 causing cavity suppression. A variety of cavity regimes are possible with the nosepiece 10 as the cavity regimes depend on the combination of h/D and We. Cavity suppression will occur when the only gas in the cavity is that which was initially trapped in the recess 18 upon water impact and has evacuated into the toroidal cavity. This is referred to as a "closed torus".

Figure 4:
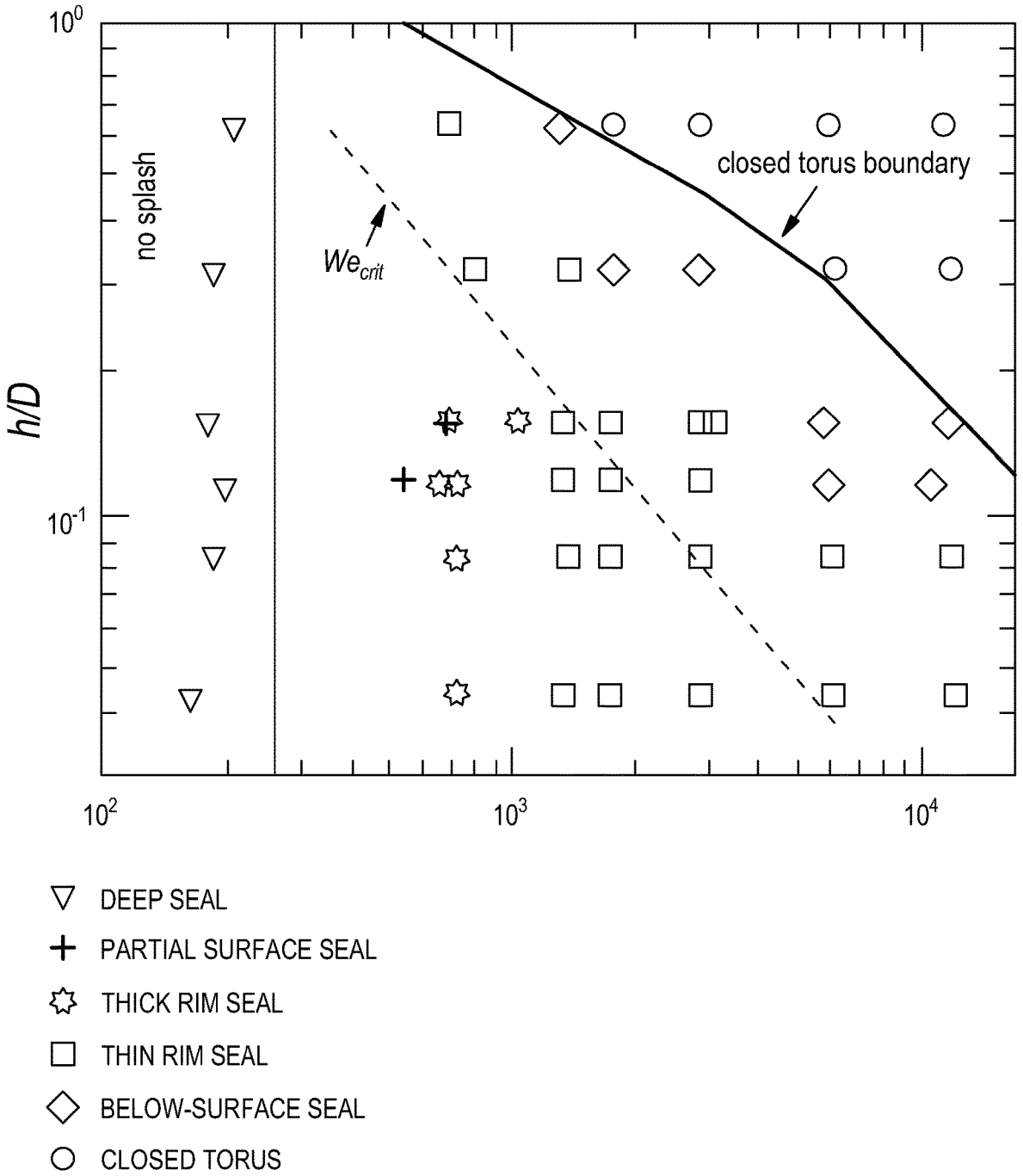
FIG. 4 is a graph of various cavity and splash regimes for water entry.

FIG. 4 is a graph of cavity and splash regimes for the water entry of a body with the inventive nosepiece 10 at different values of h/D and We. The graph depicts six different regimes of water entry at the moment of a cavity seal. As shown, a flat face with We=516 results in a deep seal.

When h/D=0.12 in a recess and a cupped face and We=562, this results in a partial surface seal. When h/D=0.16 and We=1016, this results in a thick rim seal. When h/D=0.16 and We=2972, this results in a thin rim seal. When h/D=0.32 and We=2949, this results in a below-surface seal. When h/D=0.63 and We=5916, this produces a closed torus.

The operating conditions for the body 100 determine the impact speed U and diameter D of the body to set the Weber number, $We=\rho U^2 D/\sigma$. At a given value of We, the graph of cavity and splash regimes can be referenced to find the minimum value of h/D for the nosepiece 10 to suppress a cavity.

The disclosed invention allows for the suppression of an air cavity upon water entry under conditions (i.e., impact We) that would otherwise produce cavities for most common nose geometries such as ogives, cones and disks. The nosepiece 10 is a simple and passive device having h/D in a specific range for a specific operating We.

The nosepiece 10 can be manufactured as a separate portion and attached to the body 100. In some embodiments, the nosepiece 10 can be integrated structurally into the body and manufactured as part of the body. In other embodiments, the nosepiece 10 can be a frangible nose cone mounted to the body 100. This allows the nosepiece 10 to suppress the cavity before breaking off during impact. The body 100 can then employ a more advantageous nose shape for underwater travel following the water entry.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A nosepiece for suppressing a cavity formed by a body with a nose entering a fluid medium, said nosepiece comprising:

a circular portion with a diameter "D" connected to the nose of the body, said circular portion having a cylindrical first section and a cylindrical second section with a combined length of said first cylindrical portion and said second cylindrical portion being "L"; and a recess as a formed cup in said first section at a depth h; and wherein the dimensions for diameter "D" and depth "h" are selected based on a Weber number for the body such that a cavity is suppressed as said nosepiece and the body enter the fluid medium.

2. The nosepiece in accordance with claim 1, wherein said recess has interior walls extending from said first section as a wedge inward to a base of said recess with said base being perpendicular to outside walls of said first section.

3. The nosepiece in accordance with claim 2 wherein said wedge extends to said base at an angle $\beta \approx 10°$.

4. The nosepiece in accordance with claim 3, wherein said circular portion is manufactured as a part of said body.

5. The nosepiece in accordance with claim 3 wherein said circular portion comprises a frangible portion attachable to said body; and wherein said circular portion detaches from said body following cavity suppression.

* * * * *